US009249687B2

(12) United States Patent
Nanda et al.

(10) Patent No.: US 9,249,687 B2
(45) Date of Patent: Feb. 2, 2016

(54) TURBINE EXHAUST DIFFUSION SYSTEM AND METHOD

(75) Inventors: Deepesh D. Nanda, Bangalore (IN); Joseph A. Cotroneo, Clifton Park, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1297 days.

(21) Appl. No.: 12/913,729

(22) Filed: Oct. 27, 2010

(65) Prior Publication Data

US 2012/0102956 A1 May 3, 2012

(51) Int. Cl.
*F01D 11/08* (2006.01)
*F01D 25/30* (2006.01)

(52) U.S. Cl.
CPC ..... *F01D 25/30* (2013.01); *F01D 11/08* (2013.01); *F05D 2260/14* (2013.01); *F05D 2260/60* (2013.01)

(58) Field of Classification Search
CPC ..... F01D 5/145; F01D 11/08; F01D 25/30; F05D 2270/17; F05D 2260/14; F05D 2260/60; B64C 2230/00; B64C 2230/28; F15D 1/002; F15D 1/0025
USPC ..... 60/805, 796, 798, 39.83; 415/142, 180, 415/229
See application file for complete search history.

(56) References Cited

U.S. PATENT DOCUMENTS

| | | | |
|---|---|---|---|
| 3,594,095 | A | 7/1971 | Trassel et al. |
| 3,734,650 | A | 5/1973 | Reisacher et al. |
| 3,797,234 | A | 3/1974 | Schwarz |
| 4,172,009 | A | 10/1979 | Simon et al. |
| 4,280,797 | A | 7/1981 | Pfeil |
| 4,643,345 | A | 2/1987 | Knispel et al. |
| 4,680,933 | A | 7/1987 | Bozung et al. |
| 4,744,726 | A | 5/1988 | Remberg |
| 4,770,603 | A | 9/1988 | Engels et al. |

(Continued)

FOREIGN PATENT DOCUMENTS

| | | | |
|---|---|---|---|
| CN | 101372904 | A | 2/2009 |
| CN | 101680305 | A | 3/2010 |

(Continued)

OTHER PUBLICATIONS

Tajc, L. et al.; *The Experimental Investigation of the Influence of the Flow Swirl and the Tip Clearance Jet on Aerodynamic Characteristics of Exhaust Hoods*; SKODA Power Czech Republic; 2006.

(Continued)

*Primary Examiner* — Phutthiwat Wongwian
*Assistant Examiner* — Jason H Duger
(74) *Attorney, Agent, or Firm* — Fletcher Yoder, P.C.

(57) ABSTRACT

A system includes multiple blades coupled to a rotor, a stationary shroud disposed about the multiple blades, and a clearance between the stationary shroud and each blade end of the multiple blades, wherein the clearance is configured to enable over tip leakage flow. The system also includes a diffuser section that includes an outer wall defining an expanding flow path downstream from the multiple blades. The outer wall includes a first wall portion having a first angle relative to a rotational axis of the multiple blades, and the clearance is configured to enable an increase in the first angle by maintaining the boundary layer along the outer wall with the over tip leakage flow.

15 Claims, 6 Drawing Sheets

(56) References Cited

U.S. PATENT DOCUMENTS

| | | | | |
|---|---|---|---|---|
| 5,267,434 | A | 12/1993 | Termuehlen et al. | |
| 5,338,155 | A | 8/1994 | Kreitmeier | |
| 5,560,362 | A | 10/1996 | Sliwa et al. | |
| 5,984,628 | A | 11/1999 | Gray et al. | |
| 6,050,084 | A | 4/2000 | Schuetz et al. | |
| 6,062,814 | A | 5/2000 | Baehr et al. | |
| 6,406,252 | B2 | 6/2002 | Kuhn | |
| 6,447,247 | B1 | 9/2002 | Geiger | |
| 6,487,863 | B1 | 12/2002 | Chen et al. | |
| 6,488,470 | B1 * | 12/2002 | Owczarek | 415/148 |
| 6,659,715 | B2 | 12/2003 | Kuesters et al. | |
| 6,896,475 | B2 * | 5/2005 | Graziosi et al. | 415/1 |
| 6,910,156 | B2 | 6/2005 | Adam | |
| 7,237,595 | B2 | 7/2007 | Beck et al. | |
| 7,416,394 | B2 | 8/2008 | Ahmad et al. | |
| 7,549,282 | B2 * | 6/2009 | Widenhoefer et al. | 60/39.17 |
| 8,157,509 | B2 | 4/2012 | Black et al. | |
| 8,475,125 | B2 | 7/2013 | Neeli et al. | |
| 2002/0157400 | A1 | 10/2002 | Schulten et al. | |
| 2004/0088989 | A1 | 5/2004 | Dowman | |
| 2004/0091350 | A1 * | 5/2004 | Graziosi et al. | 415/1 |
| 2005/0050899 | A1 | 3/2005 | Little | |
| 2005/0066647 | A1 | 3/2005 | Wiebe et al. | |
| 2005/0275525 | A1 | 12/2005 | Ahmed | |
| 2007/0003410 | A1 * | 1/2007 | Chehab | 415/173.1 |
| 2007/0031247 | A1 | 2/2007 | Spitzer et al. | |
| 2007/0234737 | A1 | 10/2007 | Vosberg | |
| 2008/0016971 | A1 | 1/2008 | Bunce et al. | |
| 2008/0047276 | A1 | 2/2008 | Baer et al. | |
| 2008/0063516 | A1 | 3/2008 | Fridsma | |
| 2008/0232949 | A1 | 9/2008 | Reichert et al. | |
| 2009/0053046 | A1 * | 2/2009 | Black et al. | 415/173.1 |
| 2010/0021291 | A1 * | 1/2010 | Beeck | 415/207 |
| 2010/0226767 | A1 | 9/2010 | Becker et al. | |
| 2010/0303607 | A1 * | 12/2010 | Orosa | 415/1 |

FOREIGN PATENT DOCUMENTS

| | | | |
|---|---|---|---|
| EP | 0243596 | | 5/1991 |
| EP | 1381143 | | 1/2004 |
| EP | 1873402 | | 1/2008 |
| EP | 1895122 | | 3/2008 |
| EP | 1930543 | | 6/2008 |
| EP | 1861685 | | 9/2008 |
| GB | 2440343 | | 1/2008 |
| JP | 2009036118 | A | 2/2009 |
| JP | 2010031707 | A | 9/2011 |
| WO | WO9940294 | | 8/1999 |
| WO | WO0161168 | | 8/2001 |
| WO | WO2006003071 | | 1/2006 |
| WO | WO2006074857 | | 7/2006 |
| WO | WO2006114382 | | 11/2006 |
| WO | WO2007060209 | | 5/2007 |

OTHER PUBLICATIONS

Willinger, Reinhard et al.; *The Role of Rotor Tip Clearance on the Aerodynamic Interaction of a Last Gas Turbine Stage and an Exhaust Diffuser*; ASME 98-GT-94; Presented at the International Gas Turbine & Aeroengine Congress & Exhibition, Stockholm, Sweden; Jun. 2-5, 1998.

Unofficial English Translation of Office Action issued in connection with corresponding CN Application No. 21110356026.6 on Aug. 1, 2014.

Application No. 2011-233867; Japanese Office Action mailed Sep. 15, 2015.

Application No. 1159628; FR Search Report mailed Oct. 23, 2015.

* cited by examiner

TURBINE EXHAUST DIFFUSION SYSTEM AND METHOD

BACKGROUND OF THE INVENTION

The subject matter disclosed herein relates to exhaust diffusion for turbine systems.

A gas turbine system may include an exhaust diffuser coupled to a gas turbine engine. The gas turbine engine combusts a fuel to generate hot combustion gases, which flow through a turbine to drive a load and/or compressor. The exhaust diffuser receives the exhaust from the turbine, and gradually reduces the pressure and velocity. Unfortunately, exhaust diffusers often consume a considerable amount of space. For instance, the exhaust diffuser may be as long as the gas turbine engine. Therefore, it may prove beneficial to implement design strategies for reducing the footprint of the exhaust diffuser, and, thus, the overall footprint of the gas turbine system.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In accordance with a first embodiment, a system includes a gas turbine engine. The gas turbine engine includes a combustion section and a turbine section coupled to the combustion section. The turbine section includes a turbine stage having multiple turbine blades coupled to a rotor, a stationary shroud disposed about the multiple turbine blades, and a clearance between the stationary shroud and each end of the multiple turbine blades. The turbine blades may have a rotating shroud attached to their ends or not. The gas turbine engine includes a diffuser section coupled to the turbine section. The diffuser section includes an outer wall defining an expanding flow path downstream from the multiple turbine blades. The outer wall includes a first wall portion having a first angle relative to a rotational axis of the multiple turbine blades, and the clearance is configured to enable over tip leakage flow to energize a boundary layer along the outer wall.

In accordance with a second embodiment, a system includes a rotary section. The rotary section includes multiple blades coupled to a rotor, a stationary shroud disposed about the multiple blades, and a clearance between the stationary shroud and each end of the multiple blades, wherein the clearance is configured to enable over tip leakage flow. The turbine blades may have a rotating shroud attached to their ends or not. The system also includes a diffuser section that includes an outer wall defining an expanding flow path downstream from the multiple blades. The outer wall includes a first wall portion having a first angle relative to a rotational axis of the multiple blades, and the clearance is configured to enable an increase in the first angle by maintaining the boundary layer along the outer wall with the over tip leakage flow.

In accordance with a third embodiment, a method includes enabling an over tip leakage flow to pass between a stationary shroud and multiple turbine blades of a turbine stage. The method also includes energizing a boundary layer along a wall of a turbine diffuser with the over tip leakage flow.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
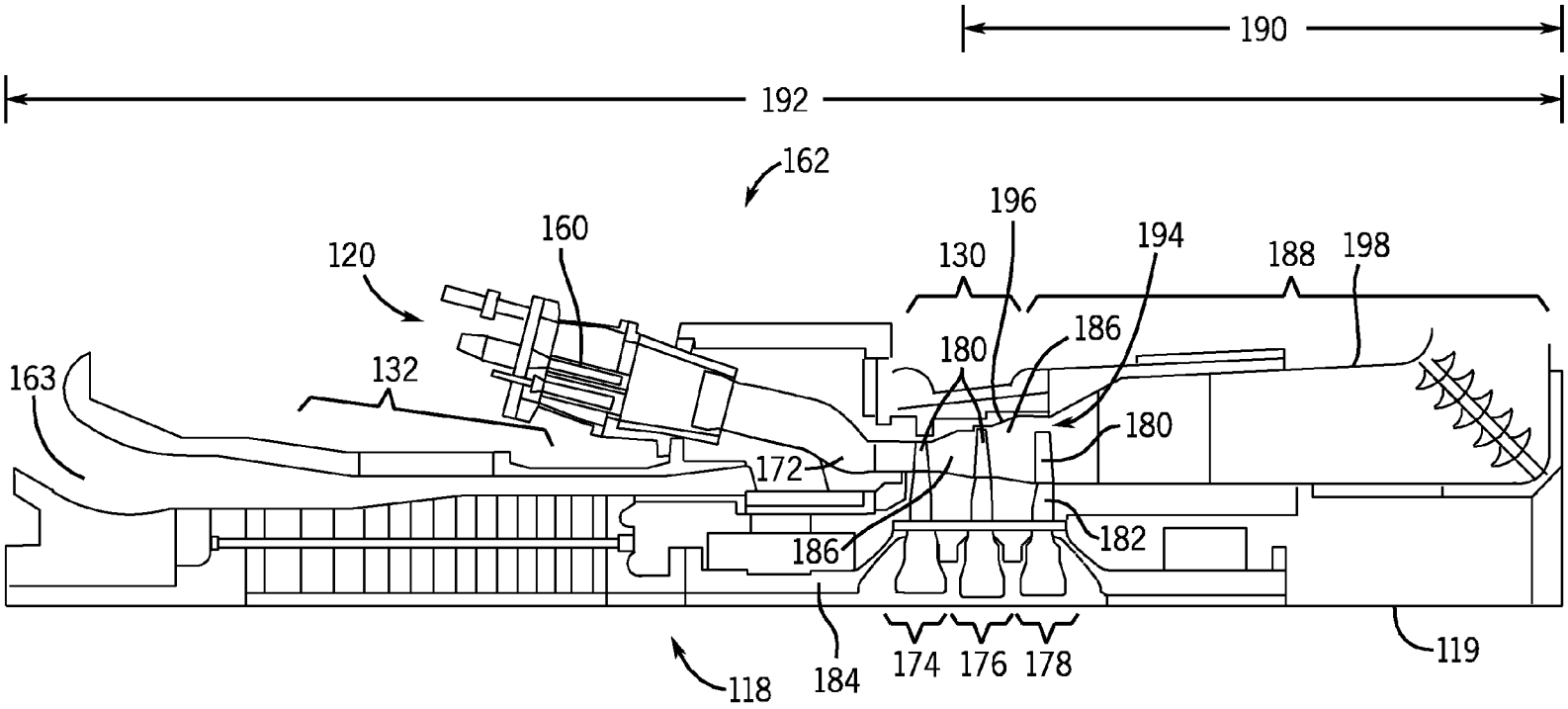
FIG. 1 is a cross-sectional side view of a gas turbine engine taken along a longitudinal axis.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The disclosed embodiments are directed to over tip leakage flow in a turbine, such as a gas turbine or steam turbine, to reduce flow separation from along an outer wall of an exhaust diffuser. In general, it may be desirable to minimize the clearance between ends of rotating blades and the surrounding stationary shroud, thereby maximizing the work of the fluid (e.g., steam or hot gases) on the rotating blades. However, some amount of clearance may be provided to reduce the possibility of rub between the blades and the stationary shroud. However, this consideration for clearance does not relate to the fluid flow downstream from the rotating blades. As discussed below, flow separation and other undesirable fluid flow may occur downstream from the rotating blades. The disclosed embodiments specifically adjust the clearance to control an over tip leakage flow, thereby controlling the fluid flow downstream of the blades. For example, the over tip leakage flow that passes between the blade ends of multiple blades and a stationary shroud disposed about the blades energizes a boundary layer along an outer wall of an exhaust diffuser, thereby allowing large angles relative to a rotational axis of the blades to be incorporated into the outer wall of the exhaust diffuser. In other words, the over tip leakage flow increases the flow velocity along the boundary layer, thus, reducing or preventing the separation of the flow from the outer wall of the exhaust diffuser that normally occurs when large angles relative to the rotational axis of the blades are used, while also maintaining the pressure recovery of the exhaust diffuser. Over tip leakage flow, while allowing an increase in the angles in the exhaust diffuser, may also allow the length of the diffuser to be reduced, as well as, the overall length of the turbine system.

FIG. 1 is a cross-sectional side view of an embodiment of a gas turbine engine 118 along a longitudinal axis 119. As appreciated, the over tip leakage flow may be used in any turbine system, such as gas turbine systems and steam turbine systems, and is not intended to be limited to any particular machine or system. As described further below, over tip leakage flow may be employed within the gas turbine engine 118 to energize a boundary layer along an outer wall of an exhaust diffuser to prevent or reduce separation of the exhaust gases from the outer wall. The over tip leakage flow originates at the clearance between rotating blades and the surrounding stationary shroud in a downstream or final turbine stage of the gas turbine engine 118. Thus, the clearance may be increased to increase the over tip leakage flow or the clearance may be decreased to decrease the over tip leakage flow. The energized boundary layer enables the outer wall to have large angles relative to the rotational axis of the turbine blades, thereby enabling a substantial reduction in the length of the exhaust diffuser. As a result, the over tip leakage flow may enable the exhaust diffuser to provide similar or improved pressure recovery with a reduced footprint.

The gas turbine engine 118 includes one or more fuel nozzles 160 located inside a combustor section 162. In certain embodiments, the gas turbine engine 118 may include multiple combustors 120 disposed in an annular arrangement within the combustor section 162. Further, each combustor 120 may include multiple fuel nozzles 160 attached to or near the head end of each combustor 120 in an annular or other arrangement.

Air enters through the air intake section 163 and is compressed by the compressor 132. The compressed air from the compressor 132 is then directed into the combustor section 162 where the compressed air is mixed with fuel. The mixture of compressed air and fuel is generally burned within the combustor section 162 to generate high-temperature, high-pressure combustion gases, which are used to generate torque within the turbine section 130. As noted above, multiple combustors 120 may be annularly disposed within the combustor section 162. Each combustor 120 includes a transition piece 172 that directs the hot combustion gases from the combustor 120 to the turbine section 130. In particular, each transition piece 172 generally defines a hot gas path from the combustor 120 to a nozzle assembly of the turbine section 130, included within a first stage 174 of the turbine 130.

As depicted, the turbine section 130 includes three separate stages 174, 176, and 178. Each stage 174, 176, and 178 includes a plurality of blades 180 coupled to a rotor wheel 182 rotatably attached to a shaft 184. Each stage 174, 176, and 178 also includes a nozzle assembly 186 disposed directly upstream of each set of blades 180. The nozzle assemblies 186 direct the hot combustion gases toward the blades 180 where the hot combustion gases apply motive forces to the blades 180 to rotate the blades 180, thereby turning the shaft 184. The hot combustion gases flow through each of the stages 174, 176, and 178 applying motive forces to the blades 180 within each stage 174, 176, and 178. The hot combustion gases may then exit the gas turbine section 130 through an exhaust diffuser section 188. The exhaust diffuser section 188 functions by reducing the velocity of fluid flow through the diffuser section 188, while also increasing the static pressure to increase the work produced by the gas turbine engine 118. As illustrated, the exhaust diffuser section 188 has a length 190, which is a portion of an overall length 192 of the gas turbine engine 118. The disclosed engine 118 provides over tip leakage flow from the turbine section 180 into the exhaust diffuser section 188 to energize the boundary layer in the exhaust diffuser section 188, thereby enabling a reduction in length 190.

In the illustrated embodiment, the last stage 178 includes a clearance 194 between ends of the plurality of blades 180 and a stationary shroud 196 disposed about the plurality of blades 180. The clearance 194 allows an over tip leakage flow to energize the boundary layer between an outer wall 198 of the exhaust diffuser section 188 and the flow of the hot combustion gases, thereby allowing the use of large angles in the diffuser section 188 and the shortening of the length 190 of the diffuser section 188 relative to the total length 192 of the gas turbine engine 118. In certain embodiments incorporating over tip leakage flow, the length 190 of the diffuser section 188 may range from approximately 25 to 50 percent, 30 to 45 percent, or 35 to 40 percent of the total length 192 of the gas turbine engine 118. For example, the length 190 of the diffuser section 188 may account for 30, 35, 40, 45, or 50 percent, or any percent therebetween of the total length 192 of the gas turbine engine 118.

Figure 2:
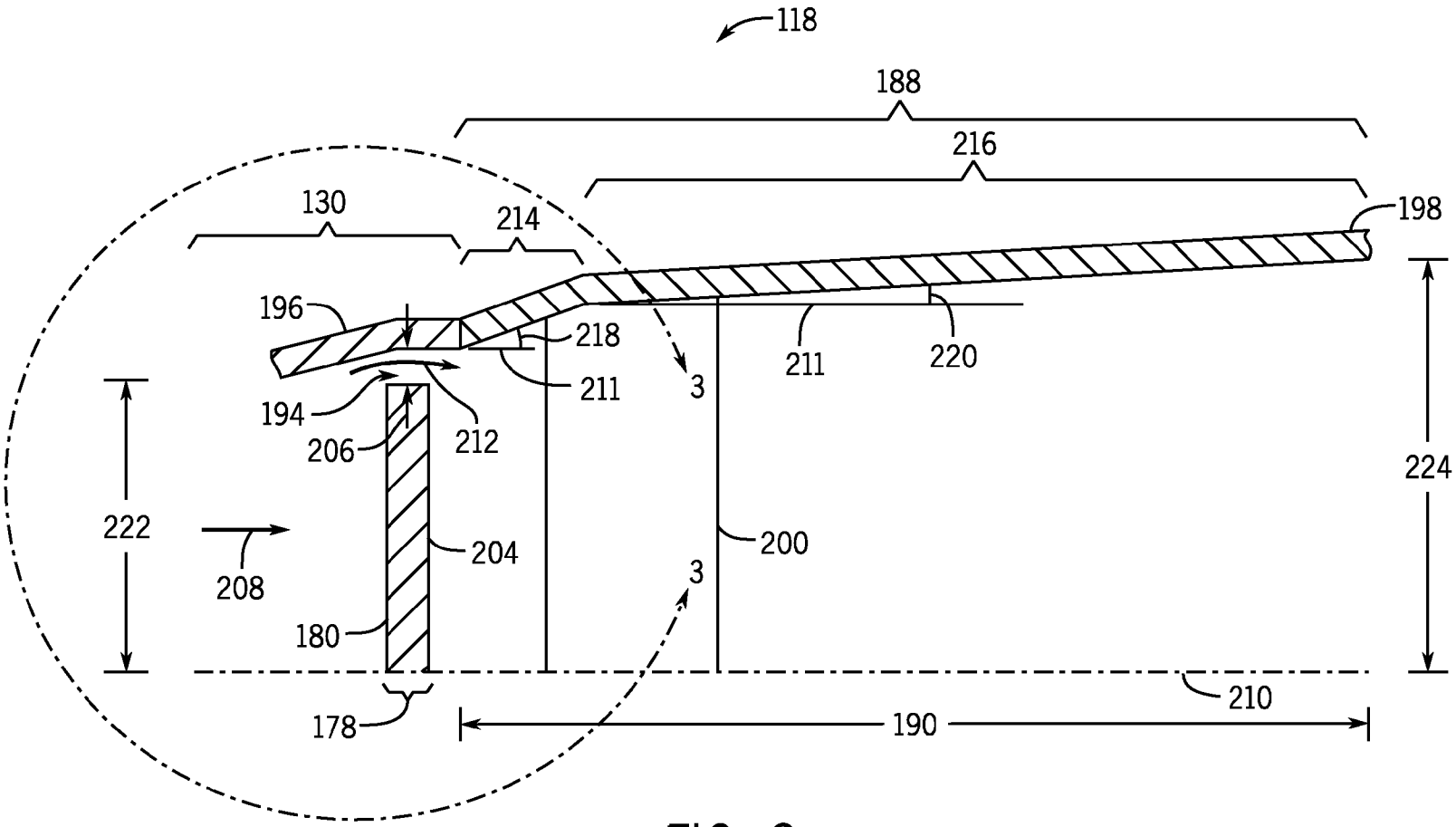
FIG. 2 is a partial cross-sectional side view of the gas turbine engine of FIG. 1 illustrating tip clearance in a turbine section with unshrouded turbine blades and large angles in a diffuser section according to an embodiment.

FIG. 2 is a partial cross-sectional view of the gas turbine engine 118 of FIG. 1 further illustrating the clearance 194 in the turbine section 130 and large angles employed in the diffuser section 188. The gas turbine engine 118 includes the turbine section 130 coupled to the diffuser section 188, as described above. The turbine section 130 section includes the stationary shroud 196 disposed about the plurality of blades 180 of the last stage 178. Each blade 180 of the plurality of blades 180 includes a blade end 204. In some embodiments, the blade end 204 may include a radial tip 204. In other embodiments, the radial end 204 may include a rotating shrouded end 205 (see FIGS. 9 and 10). Clearance 194 exists between each blade end 204 of the plurality of blades 180 and the stationary shroud 196 to allow for over tip leakage flow to energize the boundary layer along the diffuser section 188. In certain embodiments, the distance 206 of clearance 194 may range between approximately 90 to 150 mils, 100 to 140 mils, or 110 to 130 mils. By further example, the distance 206 of clearance 194 may be approximately 115, 120, 125, 130, 135, or 140 mils, or any distance 206 of clearance 194 in between. Hot combustion gases flow in direction 208 through stage 178 and apply a motive force to the plurality of blades 180 to rotate the blades 180 about a rotational axis 210. Some of the hot combustion gases flow between the clearances 194 resulting in an over tip leakage flow indicated by arrow 212.

The diffuser section 188 includes greater angles to take advantage of the over tip leakage flow 212. The diffuser section 188 includes the outer wall 198 and a strut 200 disposed radially across the diffuser section 188. The outer wall 198 defines an expanding flow path downstream from the plurality of blades 180. The outer wall 198 includes a first wall portion 214 and a second wall portion 216 downstream of the first wall portion 214. The first wall portion 214 includes a first angle 218 relative to the rotational axis 210 of the plurality of blades 180, as indicated by line 211 parallel to axis 210. In certain embodiments, the first angle 218 may range between approximately 16 to 40 degrees, 20 to 40 degrees, 20 to 30 degrees, 18 to 28 degrees, or 21 to 23 degrees. For example, the first angle 218 may be approximately 16, 18, 20, 22, or 24 degrees, or any angle therebetween. The over tip leakage flow 212 through the clearance 194 enables the increase in the first angle 218 by maintaining the boundary layer along the outer wall 198. Similarly, the second wall portion 216 includes a second angle 220 relative to the rotational axis 210 of the plurality of blades 180, as indicated by line 211 parallel to axis 210. In certain embodiments, the second angle 220 may range between approximately 6 to 12 degrees or 7 to 9 degrees. For example, the second angle 220 may be approximately 6, 8, or 10 degrees, or any angle therebetween. In some embodiments, the first angle 218 may range between approximately 20 to 24 degrees, and the second angle may range between approximately 6 to 12 degrees. The over tip leakage flow 212 may function to energize the boundary layer primarily along the first wall portion 214 at the angle 218, or also along the second wall portion 216 at the angle 220. In either case, the over tip leakage flow enables an increase in the average angle of the diffuser section 188, thereby providing more aggressive diffusion over a shorter distance by virtue of the energized boundary layer.

Incorporating the first angle 218 with the measurements above normally would cause an excessive adverse pressure gradient within the diffuser section 188 causing early flow separation from along the outer wall 198 resulting in poorer performance by the diffuser section 188. However, the over tip leakage flow 212 energizes the boundary layer and reduces or prevents the early flow separation from the outer wall 198 at least along the first wall portion 214. The over tip leakage flow 212 allows the use of a large first angle 218 within the diffuser section 188 and a shortening of the length 190 of the diffuser section 188 relative to the total length 192 of the gas turbine engine 118, while still maintaining diameters 222 and 224 of diffuser section inlet and outlet, respectively. In addition, shortening the length 190 of the diffuser section 188 creates a higher diffusion area ratio per unit length of the diffuser section 188, while maintaining a total diffusion area of the diffuser section 188 for diffusion recovery. As a result, the large first angle 218, in conjunction with the over tip leakage flow 212, allows for at least the same or improved pressure recovery and diffuser performance in a shorter turbine section 188. In certain embodiments, reduction in the length 190 of the diffuser section 188 may range from 30 to 60 percent. As a result, the length 190 of the diffuser section 188 may be at least less than approximately 15 percent of the total length 192 of the gas turbine engine 118.

Figure 3:
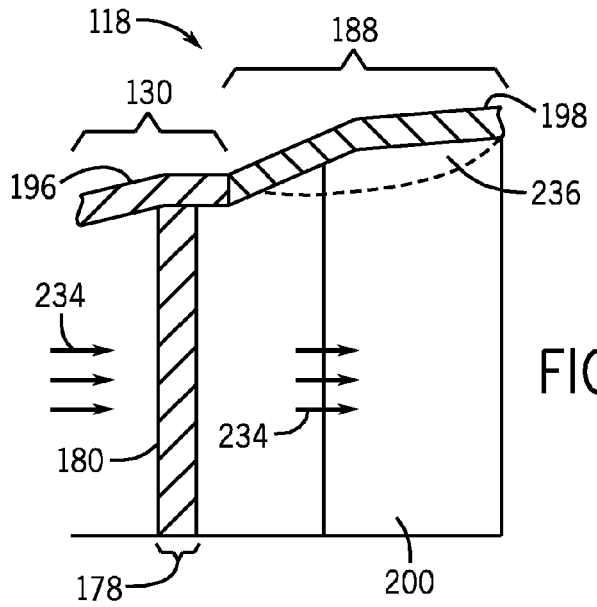
FIG. 3 is a partial cross-sectional side view of an embodiment of the gas turbine engine with no clearance.
Figure 4:
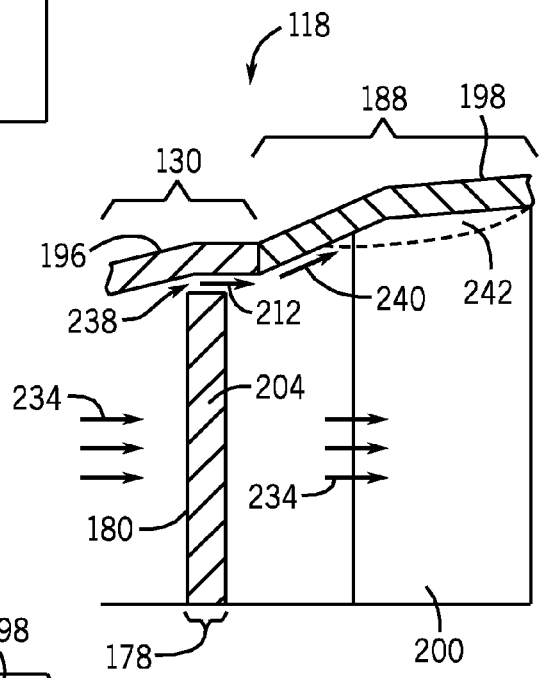
FIG. 4 is a partial cross-sectional side view of an embodiment of the gas turbine engine with a first clearance.
Figure 5:
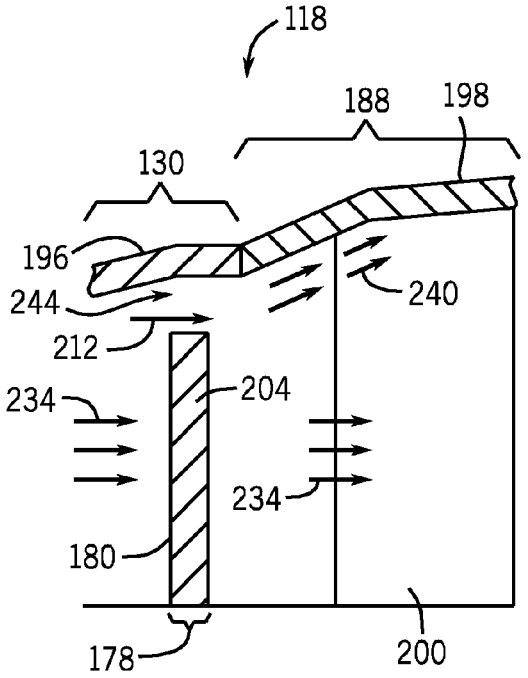
FIG. 5 is a partial cross-sectional side view of an embodiment of the gas turbine engine with a second clearance.

FIGS. 3-5 are partial cross-sectional views of the gas turbine engine 118 of FIG. 1 taken within line 3-3, further illustrating how clearance 194 affects the boundary layer along the outer wall 198 of the diffuser section 188. The gas turbine engine 188 of FIGS. 3-5 includes the turbine section 130 coupled to the diffuser section 188, as described above. The turbine section 130 includes the stationary shroud 196 disposed about the plurality of blades 180 of the last stage 178. The diffuser section 188 includes the outer wall 198 and the large angles described above, as well as, the strut 200 radially disposed within the diffuser section 188.

FIG. 3 illustrates an embodiment of gas turbine engine 118 with no clearance 194 between each blade end 204 of the plurality of blades 180 and the stationary shroud 196. Hot combustion gases flow generally in axial direction 234 through stage 178 and apply a motive force to the plurality of blades 180 to rotate the blades 180. Generally, the flow of the hot combustion gases expands both in a radial and axial direction along the diffuser section 188. However, the large angles at the inlet of the diffuser section 188 near the turbine section 130 adversely affects the pressure gradient, as well as, reduces axial and radial velocities of the gas flow within the diffuser section 188. The lack of axial and radial momentum within the gas flow results in stalling of the flow and an early large separation 236 along the boundary layer between the flow of the combustion gases and the outer wall 198 of the diffuser section 188.

However, providing some clearance 194 reduces the amount of separation along the boundary layer. FIG. 4 illustrates an embodiment of the gas turbine engine 118 with a first tip clearance 238 between the blade ends 204 of the plurality of the blades 180 and the stationary shroud 196. The first clearance 238 allows some over tip leakage flow 212 over the blade ends 204 of the plurality of the blades 180. The over tip leakage flow 212 is a high momentum, high energy flow that imparts some additional momentum to direct exhaust flow 240 directly along the outer wall 198. The over tip leakage flow 212 imparts swirl and radial momentum to the exhaust flow 240, thereby energizing the boundary layer. The energized boundary layer results in less separation 242 between the flow of the combustion gases and the outer wall 198 of the diffuser section 188.

Increasing the clearance 194 imparts even greater momentum and energy to the exhaust flow 240 (e.g., swirl and radial momentum) of the combustion gases. FIG. 5 illustrates an embodiment of the gas turbine engine 118 with a second clearance 244 greater than the first clearance 238 of FIG. 4. The second clearance 244 allows a greater amount of over tip leakage 212 over the blade ends 204 of the plurality of the blades 180. The over tip leakage flow 212 between the second clearance 244 produces a high momentum, high energy 240 flow greater than that provided with the first clearance 238. This over tip leakage flow 212 imparts enough additional momentum to the exhaust flow 240 of the combustion gases to energize the boundary layer with the outer wall 198 of the diffuser section 188 and to substantially prevent the formation of any separation along the boundary layer. Thus, the over tip leakage flow 212 counters the separation normally caused by large angles in the diffuser section 188.

Figure 6:
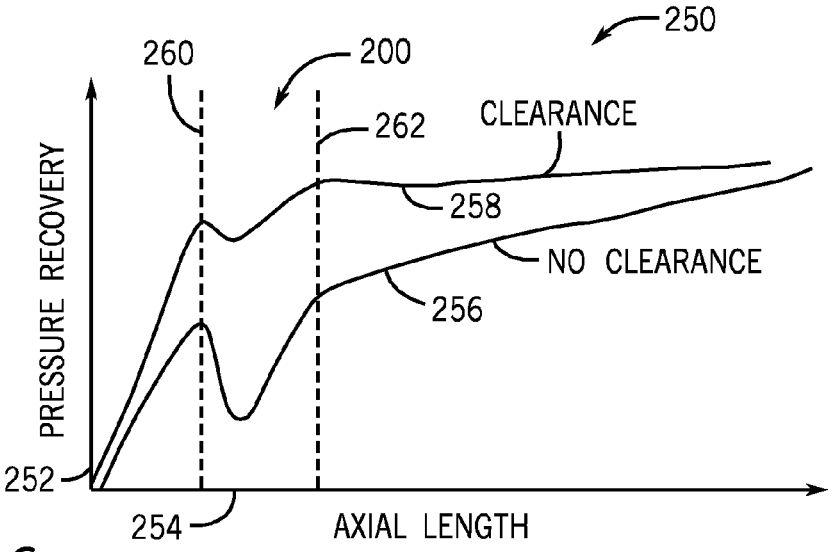
FIG. 6 is a graph illustrating pressure recovery over an axial length of the diffuser section with large angles according to an embodiment.

FIG. 6 is a graph 250 representing pressure recovery over the axial length 190 of embodiments of the diffuser section 188 that incorporate the large angles described above. In the graph 250, y-axis 252 represents the pressure recovery of the diffuser section 188 and x-axis 254 represents the axial length 190 of the diffuser section 188. The pressure recovery increases from bottom to top along the y-axis 252. The axial length 190 of the diffuser section 188 increases from left to right along the x-axis 254. Plot 256 represents the pressure recovery along the axial length 190 of an embodiment of the diffuser section 188 where the turbine section 130 has no clearance 194 between the blade ends 204 of the plurality of the blades 180 and the stationary shroud 196. Plot 258 represents the pressure recovery along the axial length 190 of an embodiment of the diffuser section 188 where the turbine section 130 has clearance 194 between the blade ends 204 of the plurality of the blades 180 and the stationary shroud 196. Dashed lines 260 and 262 represent the location of the strut 200 along the axial length 190 of the diffuser section 188. More specifically, dashed lines 260 and 262 represent the leading and trailing edges of the strut 200, respectively.

Plot 256 illustrates, in the absence of clearance 194, a gradual increase in pressure recovery initially along the axial length 190 of the diffuser section 188. As the flow of the combustion gases encounter the leading edge of the strut 200, represented by dashed line 260, the amount of pressure recovery sharply decreases due to flow interaction with the strut 200, but recovers and gradually increases as the flow approaches the trailing edge of the strut 200, represented by dashed line 262, as shown in plot 256. After the strut 200, the pressure recovery gradually increases along the rest of the axial length 190 of the diffuser section 188.

Plot 258 illustrates, in the presence of clearance 194, similar to plot 256, an increase in pressure recovery, but at a greater rate, initially along the axial length 190 of the diffuser section 188. Also, similarly, as the flow of the combustion gases encounter the leading edge 260 of the strut 200, the amount of pressure recovery decreases due to flow interaction with the strut 200, but only slightly, then recovers and increases an upper level of pressure recovery as the flow approaches the trailing edge 262 of the strut 200, as shown in plot 258. After the strut 200, the pressure recovery remains at the upper level of pressure recovery along the rest of the axial length 190 of the diffuser section 188. The graph 200 illustrates that in the presence of clearance 194, as shown in plot 258, pressure recovery occurs at a greater rate and reaches the maximum obtainable pressure recovery sooner along the axial length 190 of the diffuser section 188 than in the absence of clearance 194, as shown in plot 256. As a result of this earlier and greater pressure recovery due to clearance 194, which allows over tip leakage flow 212, large angles may be used in the diffuser section 188 allowing the shortening of the diffuser section 188 in relation to the gas turbine engine 118.

Figure 7:
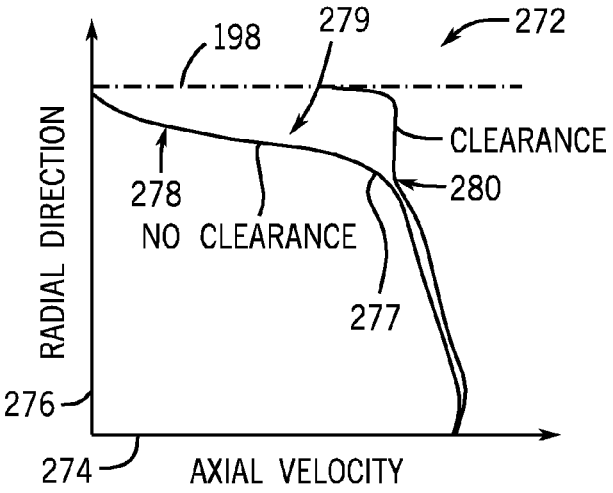
FIG. 7 is a graph illustrating axial velocity versus radial position in the diffuser section with large angles according to an embodiment.
Figure 8:
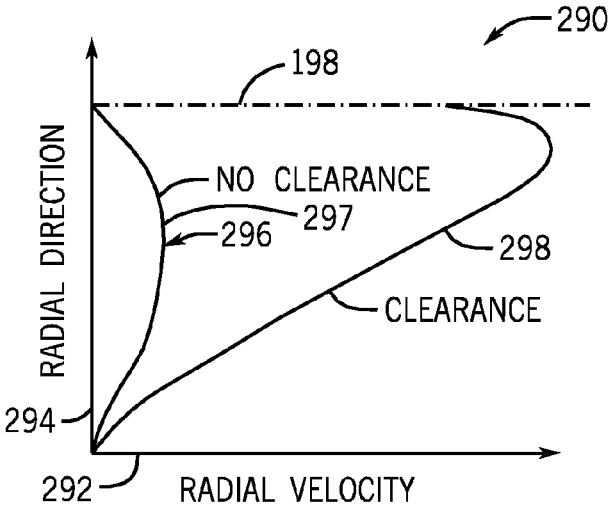
FIG. 8 is a graph illustrating radial velocity versus radial position in the diffuser section with large angles according to an embodiment.

FIGS. 7 and 8 illustrate the impact of over tip leakage flow 212 on the axial and radial momentum of the flow of the combustion gases downstream of the inlet to the diffuser section 188, but prior to encountering the strut 200, in embodiments of the diffuser section 188 with large angles. FIG. 7 is a graph 272 representing axial velocity of the flow of the combustion gases with distance in a radial direction (i.e., the expansion in a radial direction along the length 190 of the diffuser section 188). In the graph 272, x-axis 274 represents the axial velocity and y-axis 276 represents the distance in the radial direction. The distance in the radial direction increases from bottom to top along the y-axis 276. The axial velocity of the flow of the combustion gases increases from left to right along the x-axis 274. Plot 278 represents the axial velocity of the flow of combustion gases as the flow expands in the radial direction within the diffuser section 188 where the turbine section 130 has no clearance 194 between the blade ends 204 of the plurality of blades 180 and the stationary shroud 196. Plot 280 represents the axial velocity of the flow of combustion gases as the flow expands in the radial direction where the turbine section 130 has clearance 194 between the blade ends 204 of the plurality of the blades 180 and the stationary shroud 196.

Plot 278 illustrates that, in the absence of clearance 194, the axial velocity slightly decreases as the flow of the combustion gases expands in the radial direction toward the outer wall 198 until the flow expansion proceeds to a point 277 where the expansion results in the sudden and significant loss of axial velocity in the flow of the combustion gases. This sudden loss of axial velocity occurs due to the stalling of the flow of the combustion gases, as a result of the large angles within the diffuser section 188. The low velocity region 279 near the outer wall 198 represents significant flow separation from the outer wall 198. Plot 280 illustrates, in the presence of clearance 194, a slight decrease in axial velocity as the flow of the combustion gases expands in the radial direction. However, as shown in plot 280, the flow of the combustion gases maintains axial velocity, in the presence of over tip leakage flow 212 due to clearance 194, as the flow expands in the radial direction toward the outer wall 198. Thus, the plot 280 does not exhibit the low velocity region 279. Plot 280 illustrates the imparting of momentum and energy to the flow of the combustion gases to maintain the boundary layer (e.g., prevent the stalling of the flow and separation along the boundary layer) along the outer wall 198 of the diffuser section 188. Thus, the over tip leakage flow 212 enables increased of the outer wall 198, while substantially preventing flow separation.

FIG. 8 further illustrates the energizing of the flow of the combustion gases by the over tip leakage flow 212. FIG. 8 is a graph 290 representing radial velocity of the flow of the combustion gases with distance in a radial direction (i.e., the expansion in a radial direction along the length 190 of the diffuser section 188). In the graph 290, x-axis 292 represents the radial velocity and y-axis 294 represents the distance in the radial direction. The distance in the radial direction increases from bottom to top along y-axis 294. The radial velocity of the flow of the combustion gases increases from left to right along the x-axis 292. Plot 296 represents the radial velocity of the flow of the combustion gases as the flow expands in the radial direction within the diffuser section 188, where the turbine section 130 has no clearance 194 between the blade ends 204 of the plurality of blades 180 and the stationary shroud 196. Plot 298 represents the radial velocity of the flow of the combustion gases as the flow expands in the radial direction, where the turbine section 130 has clearance 194 between the blade ends 204 of the plurality of the blades 180 and the stationary shroud 196.

Plot 296 illustrates that, in the absence of clearance 194, the radial velocity slightly increases as the flow of the combustion gases expands in the radial direction toward the outer wall 198 until the flow expansion proceeds to a point 297 where the expansion results in the steady loss of radial velocity in the flow of the combustion gases. The loss of radial velocity, as with the loss of the axial velocity, occurs due to the stalling of the flow of the combustion gases, as a result of the large angles within the diffuser section 188. Plot 298 illustrates, in the presence of over tip leakage flow 212 from clearance 194, a sharp and significant increase in radial velocity occurs as the flow of the combustion gases expands toward the outer wall 198. The radial velocity even continues to increase during expansion, as shown in plot 298, past the point 297 in expansion where in plot 296 the radial velocity decreased. Plot 298 illustrates that the over tip leakage flow 212 imparts a significant amount of energy and momentum to the flow of the combustion gases to increase the radial flow velocity to substantially reduce or eliminate flow separation along the outer wall 198 of the diffuser section 188 in the presence of large angles.

Figure 9:
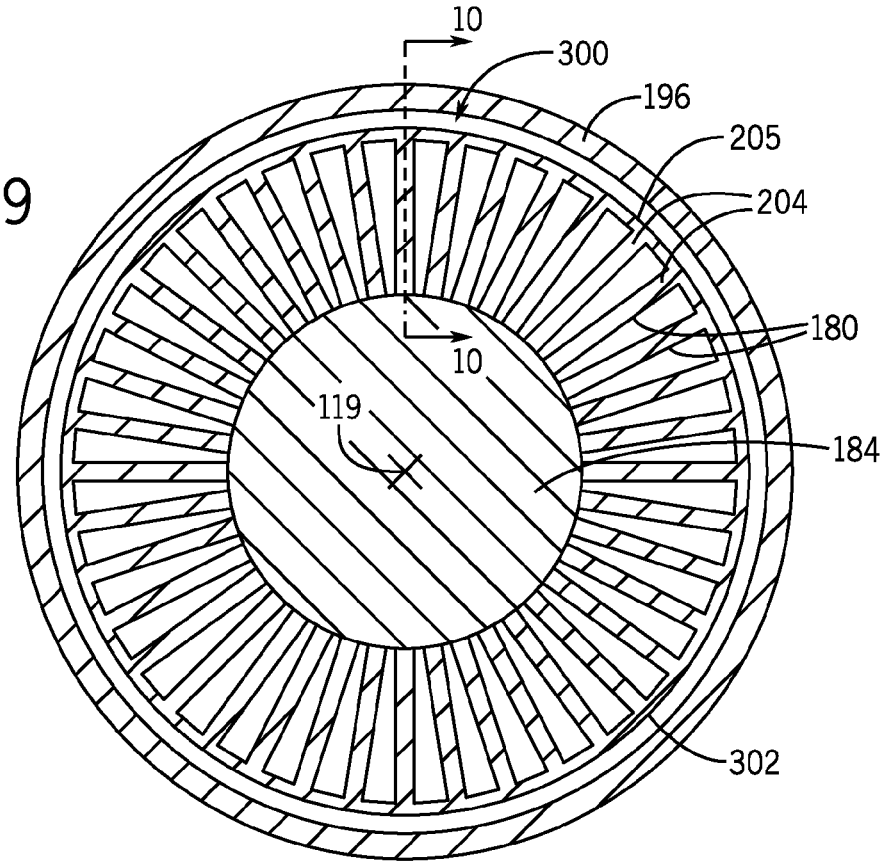
FIG. 9 is a cross-sectional view of an embodiment of the gas turbine engine crosswise to the longitudinal axis with clearance between rotating shrouded ends of blades and stationary shroud.

As mentioned above, the blade ends 204 of the plurality of blades 180 may include shrouded ends 205. FIG. 9 is a cross-sectional view of an embodiment of the gas turbine engine 118 crosswise to the longitudinal axis 119 with clearance 300 between the shrouded ends 205 of blades 180 and the stationary shroud 196. As illustrated, the blade ends 204 of adjacent blades 180 in, e.g., stage 178 include shrouded ends 205 that form an annular shroud 302 that circumferentially surrounds the blades 180. Over tip leakage flow may be employed as described above using clearance 300 between the stationary shroud 196 and the annular shroud 302, as described in the above embodiments.

Figure 10:
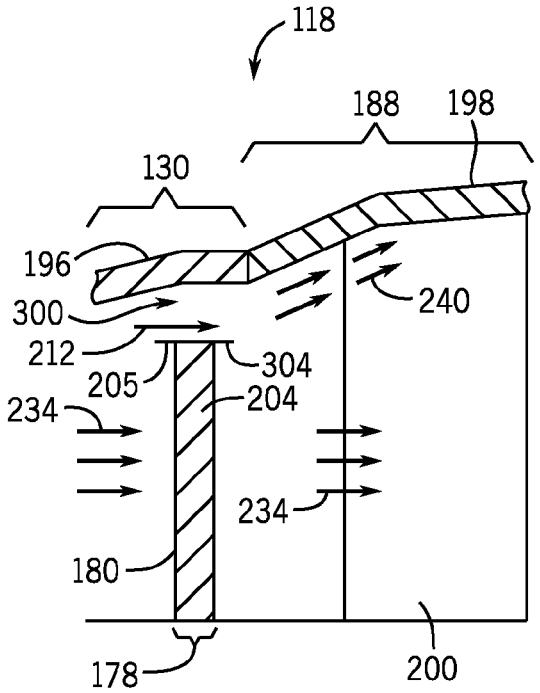
FIG. 10 is a partial cross-sectional side view of an embodiment of the gas turbine engine with clearance, taken along line 10-10 of FIG. 9.

FIG. 10 is a partial cross-sectional side view of an embodiment of the gas turbine engine 118, taken along line 10-10 of FIG. 9, further illustrating the clearance 300 between the shrouded ends 205 of the plurality of blades 180 and the stationary shroud 196. Each shrouded end 205 includes a cover 304. The clearance 300 allows over tip leakage 212 over the shrouded ends 205 of the plurality of the blades 180, as described above. The over tip leakage flow 212 between the clearance 300 produces a high momentum, high energy 240 flow. This over tip leakage flow 212 imparts enough additional momentum to the exhaust flow 240 of the combustion gases to energize the boundary layer with the outer wall 198 of the diffuser section 188 and to substantially prevent the formation of any separation along the boundary layer. Thus, the over tip leakage flow 212 counters the separation normally caused by large angles in the diffuser section 188.

Figure 11:
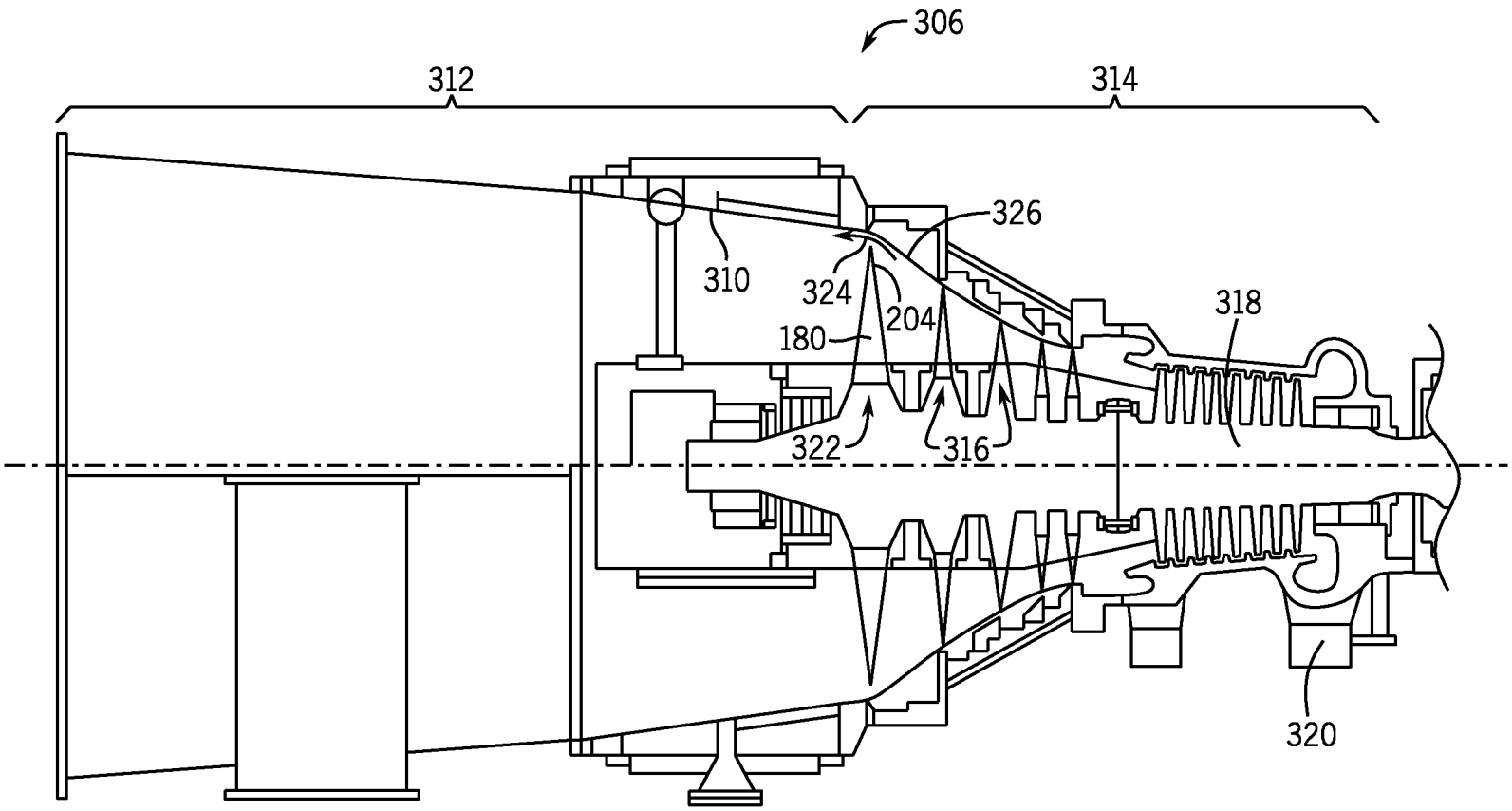
FIG. 11 is a partial cross-sectional side view of a steam turbine engine.

As mentioned above, over tip leakage flow 212 may be used in a steam turbine system. FIG. 11 is a partial cross-sectional side view of a steam turbine engine 306. Similar to the gas turbine engine 118, over tip leakage flow 212 may be employed with the steam turbine engine 306 to energize a boundary layer along outer wall 310 of exhaust diffuser 312 to prevent or reduce separation of the steam from the outer wall 310. As illustrated, the steam turbine engine 306 is an axial exhaust steam turbine engine 306. The steam turbine engine 306 includes turbine section 314 that includes multiple stages 316. Each stage 316 includes a plurality of blades 180 arranged in rows that extend circumferentially around a shaft 318. Each blade 180 includes a blade end 204. In certain embodiments, the blade ends 204 may include blade tips 204. In other embodiments, the blade ends 204 may include shrouded ends 205. Each stage 316 also includes a nozzle assembly disposed upstream from each set of blades 180. Steam enters an inlet 320 of the steam turbine engine 306 and is channeled through the nozzle assemblies. The nozzle assemblies direct the steam toward the blades 180 where steam applies motive forces to the blades 180 to rotate the blades 180, thereby turning the shaft 318. The steam flows through each stage 316 applying motive forces to the blades 180 within each stage 316. The steam then exits the turbine section 314 through the exhaust diffuser section 312.

In the illustrated embodiment, a last stage 322 includes clearance, as generally indicated by arrow 324, between the blade ends 204 of the plurality of blades 80 and a shroud 326 disposed about the plurality of blades 180. In certain embodiments, the distance of clearance 324 may range from between approximately 100 to 250 mils. The clearance allows over tip leakage flow 212, as described above, and, thus, allowing the use of large angles in the diffuser section 312 and the shortening of the diffuser section 312 relative to the total length of the steam turbine engine 306. The length of the diffuser section 312 may range from approximately 20 to 60 percent, or any percent therebetween of the total length of the steam turbine engine 306.

In certain embodiments, a method of operating a turbine system may include enabling over tip leakage flow 212 to energize a boundary layer and to prevent flow separation downstream from a turbine, e.g., in a diffuser section 188. For example, the method may include enabling over tip leakage flow 212 to pass between the stationary shroud 196 and the plurality of turbine blades 180 of turbine stage 178. The method also includes energizing the boundary layer along the wall 198 of the turbine diffuser 188 with the over tip leakage flow 212. The method may further include radially expanding the flow from the plurality of turbine blades 180 in a downstream direction through the first portion 214 of wall 198 having an angle at least greater than or equal to approximately 16 degrees, wherein the energizing maintains the boundary layer along the first portion 214. In some embodiments, the angle may be at least greater than or equal to approximately 20 degrees. The method, additionally, may include radially expanding the flow from the first portion 214 of wall 198 to the second portion 216 of the wall 198 having an angle at least greater than or equal to approximately 6 degrees. Also, the method may include diffusing an exhaust flow from the turbine stage through the turbine diffuser 188 over length 190 that is at least less than approximately 15 percent of the total length 192 of turbine engine 118 having the turbine stage 178 and the turbine diffuser 188.

Technical effects of the disclosed embodiments include providing large angles in the diffuser section 188 of a turbine system. Also, providing clearance 194 allows the over tip leakage flow 212 to energize and provide momentum to the flow during radial expansion through the diffuser section 188 to prevent the separation of the flow from the wall 198 that normally occurs with large angles. Using the large angles, in conjunction with the over tip leakage flow 212, allows the length of the diffuser section 188, as well as the total length of the turbine system to be reduced while at least maintaining, if not improving, performance. By shortening the lengths of the diffuser section 188 and turbine system the foot prints of each may be reduced.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a gas turbine engine, comprising:

a combustion section;

a turbine section coupled to the combustion section, wherein the turbine section comprises a turbine stage having a plurality of turbine blades, each blade of the plurality of turbine blades having a blade end at a first end and a second end coupled to a rotor, and a stationary shroud disposed about the plurality of turbine blades that defines a clearance between each blade end of the plurality of turbine blades and an innermost surface of the stationary shroud that is disposed at an oblique angle relative to a rotational axis of the plurality of turbine blades; and a diffuser section coupled to the turbine section, wherein the diffuser section comprises an outer wall defining an expanding flow path downstream from the plurality of turbine blades, the outer wall comprises a first wall portion that contacts and extends from the stationary shroud, the first wall portion having a first angle relative to the rotational axis of the plurality of turbine blades, the first angle is between 16 and 40 degrees, and when over tip leakage flow flows through the clearance between each blade end and the innermost surface of the stationary shroud, the over tip leakage flow energizes and maintains a boundary layer along the outer wall.

2. The system of claim 1, wherein the outer wall comprises a second wall portion downstream from and contacting the first wall portion, the second wall portion has a second angle relative to the rotational axis of the plurality of turbine blades, and the second angle is between 6 and 15 degrees.

3. The system of claim 2, wherein the first angle is between 20and 30 degrees.

4. The system of claim 1, wherein the clearance enables the over tip leakage flow to increase a radial flow velocity in the diffuser section to reduce flow separation along the outer wall.

5. The system of claim 1, wherein the clearance is between 90 and 150 mils.

6. The system of claim 1, wherein the diffuser section has a length and the gas turbine engine has a total length, and the length is less than 15percent of the total length.

7. A system, comprising:

a rotary section comprising a plurality of blades, each blade of the plurality of blades having a blade end at a first end and a second end coupled to a rotor, and a stationary shroud disposed about the plurality of blades that defines a clearance between each blade end of the plurality of blades and an innermost surface of the stationary shroud that is disposed at an oblique angle relative to a rotational axis of the plurality of blades; and a diffuser section comprising an outer wall defining an expanding flow path downstream from the plurality of blades, wherein the outer wall comprises a first wall portion that contacts and extends from the stationary shroud, the first wall portion having a first angle relative to the rotational axis of the plurality of blades, the first angle is between 16 and 40 degrees, and when over tip leakage flow flows through the clearance between each blade end and the innermost surface of the stationary shroud, the over tip leakage flow energizes and maintains a boundary layer along the outer wall.

8. The system of claim 7, wherein the rotary section comprises a turbine section.

9. The system of claim 7, wherein the outer wall comprises a second wall portion downstream from and contacting the first wall portion, the second wall portion has a second angle relative to the rotational axis of the plurality of blades, and the second angle is between 6 and 15 degrees.

10. The system of claim 9, wherein the first angle is between 21 and 23 degrees, the second angle is between 7 and 9 degrees.

11. The system of claim 7, wherein, the clearance enables the over tip leakage flow to increase a radial flow velocity in the diffuser section to substantially reduce or eliminate flow separation along the outer wall.

12. A method, comprising:

enabling an over tip leakage flow to pass through a clearance between each blade end of a plurality of turbine blades of a turbine stage and an innermost surface of a stationary shroud that is disposed at an oblique angle relative to a rotational axis of the plurality of turbine blades;

radially expanding a flow from the plurality of turbine blades in a downstream direction through a first portion of a wall of a turbine diffuser that contacts and extends from the stationary shroud, the first wall portion having a first angle relative to the rotational axis of the plurality of turbine blades between 16 and 40 degrees; and energizing and maintaining a boundary layer along the first portion of the wall of the turbine diffuser with the over tip leakage flow.

13. The method of claim 12, wherein the first angle is between 20 and 30 degrees.

14. The method of claim 12, comprising radially expanding the flow from the plurality of turbine blades from the first portion of the wall in the downstream direction through a second portion of the wall contacting the first wall portion and having a second angle relative to the rotational axis of the plurality of turbine blades between 6 and 15 degrees.

15. The method of claim 12, comprising diffusing an exhaust flow from the turbine stage through the turbine diffuser over a length that is less than 15 percent of a total length of a turbine engine having the turbine stage and the turbine diffuser.

* * * * *